US009301632B2

(12) United States Patent
Harris

(10) Patent No.: US 9,301,632 B2
(45) Date of Patent: Apr. 5, 2016

(54) ZIPPER ASSIST DEVICE AND METHOD

(71) Applicant: Cory Harris, Nampa, ID (US)

(72) Inventor: Cory Harris, Nampa, ID (US)

( * ) Notice: Subject to any disclaimer, the term of this patent is extended or adjusted under 35 U.S.C. 154(b) by 0 days.

(21) Appl. No.: 14/731,234

(22) Filed: Jun. 4, 2015

(65) Prior Publication Data

US 2015/0265084 A1 Sep. 24, 2015

Related U.S. Application Data

(63) Continuation-in-part of application No. 14/137,388, filed on Dec. 20, 2013.

(51) Int. Cl.

| | |
|---|---|
| ***A44B 19/00*** | (2006.01) |
| ***A47G 25/90*** | (2006.01) |
| ***A44B 19/26*** | (2006.01) |

(52) U.S. Cl.

CPC ..... *A47G 25/902* (2013.01); *A44B 19/262* (2013.01)

(58) Field of Classification Search

CPC ..... A47G 25/902; A47G 25/90; A47G 25/00; A44B 19/262; A44B 19/285; A44B 19/02

USPC ..... 294/3.6

See application file for complete search history.

(56) References Cited

U.S. PATENT DOCUMENTS

| | | | | | |
|---|---|---|---|---|---|
| 2,531,805 | A * | 11/1950 | Clark | 294/3.6 | |
| 2,840,412 | A * | 6/1958 | Lancaster | 294/3.6 | |
| 2,887,752 | A * | 5/1959 | Maio | 294/3.6 | |
| 3,249,977 | A * | 5/1966 | Cloud, Sr. | 294/3.6 | |
| 3,599,274 | A * | 8/1971 | Donovan | 294/3.6 | |
| 3,704,491 | A * | 12/1972 | Burgess | 294/3.6 | |
| 4,022,506 | A * | 5/1977 | Cloud, Sr. | 294/3.6 | |
| 4,027,369 | A * | 6/1977 | Kando et al. | 29/766 | |
| 5,855,401 | A * | 1/1999 | Papernik | A47G 25/901 | 24/40 |
| 8,371,003 | B2 * | 2/2013 | Arney et al. | 24/429 | |
| 8,910,983 | B1 * | 12/2014 | Neff | 294/3.6 | |
| 2003/0189345 | A1 * | 10/2003 | Altrich et al. | 294/3.6 | |
| 2012/0169076 | A1 * | 7/2012 | Brake et al. | 294/3.6 | |

* cited by examiner

*Primary Examiner* — Gabriela Puig

(74) *Attorney, Agent, or Firm* — Robert L. Shaver; Shaver & Swanson, LLP

(57) ABSTRACT

A zipper closure device for assisting in the closing of a zipper on a garment. The device has spring operated jaws which close on a zipper pull and grip the zipper pull by pressure on the sides of the zipper pull, until released. Attached to the clamp is a pull strap which allows the zipper to be pulled from above or below to more easily close or open the zipper, without the need to reach a zipper in the middle of a user's back.

6 Claims, 2 Drawing Sheets

ZIPPER ASSIST DEVICE AND METHOD

PRIORITY/CROSS-REFERENCE TO RELATED APPLICATIONS

This application claims the benefit of U.S. Non-Provisional application Ser. No. 14/137,388, filed Dec. 20, 2013, is a continuation-in-part, the disclosure of which is incorporated by reference.

TECHNICAL FIELD

The disclosed technology generally relates to a device for operating a zipper, and more particularly to a device for reaching and operating a zipper that is out of reach on someone's back.

BACKGROUND

Various devices have been developed to hold clothing together. Of these, zippers have proven to be very popular. Zippers have been placed on hundreds are articles including boots, bags, coats, and dresses. Sometimes, however, these zippers are placed in areas that make them difficult to operate, such as the back of a dress.

Given the limited mobility of the human shoulder, closing a zipper on the back of a dress or shirt often requires help from an additional person. Compounding the problem is that zippers use many different pull tabs that can be flat, round, short, long, narrow, or fat. It is desirable to have a zipper pull aid that can hold a variety of different zipper pull tabs and allow a user to pull the zipper closed without having to reach the actual pull tab with fingers. There are a number of different zipper assist devices on the market, but almost all engage the zipper pull by a small hole that is present in many zipper pulls. The prior art zipper assist devices thus have a small hook or pin that is placed through the small hole in the zipper pull. However, some zippers are very small and have no hole in the pull tab, requiring the pull tab to be grasped by the fingers and closed or opened by moving the zipper slider up and down by the fingers.

SUMMARY OF THE DISCLOSURE

The disclosed technology is a device to allow a user to operate a zipper even though the user cannot reach the zipper with a hand, and if the zipper pull does not have a hole to which to attach a standard zipper assist device. The device includes a clamp capable of attaching to a zipper pull tab, and an elongated member, such as a rod or flexible cord or piece of fabric. The rod or strap is attached to the clamp and when in use the clamp is attached to the base of the zipper pull with the jaws of the clamp. This device does not use the hole which is found in some zippers, and physically clamps onto the zipper pull. Once the clamp is secured onto the zipper pull tab, the user can grasp the rod or cord in a biomechanically compatible position and pull the zipper in the desired direction, either up or down.

One example of the use of the device is a zipper on the back of a dress or shirt. A zipper positioned in an awkward position such as on the back of a dress may be difficult or impossible to grasp and operate without considerable effort, and risk of entangling either the garment or skin in the zipper. Any physical impairment of flexibility or range of motion only makes this task more difficult. To use the disclosed device, the user can attach the zipper assist device to the zipper pull tab and raise the pull strap to point upward with one hand. The zipper assist device can be attached before the dress is put on, when partially on, or when fully put on, depending on the flexibility of the user. The same benefit is present when the device is used on other zippers, such as zippers on shoes wetsuits, tents, etc. The pull strap can be a rigid bar of metal, plastic or wood, or it can be a fabric strap, a piece of ribbon, a cord or string, a chain, or other pulling device which may be rigid or flexible. With one hand the user can grasp the pull strap above or over a shoulder, or behind one's back. The user can then pull the pull strap bar and the zipper pull tab upward to close the zipper. When the zipper is closed the user can release the clamp from the zipper pull tab and store the device for future use.

The type of clamp used in the device can be any number of clamps which have spring loaded jaws with the spring pressing the jaws together. Some clamps of this type are called alligator clamps, but other clamps with or without a spring may be used. A notch in one or both of the clamp jaws is preferred, for securing the zipper at the base of the pull tab. For instance, a type of a clamp called a hemostat used in the medical profession would be suitable for this device, and it does not have a spring except the inherent spring in the handles as they are flexed against the closed teeth. In a spring type clamp the spring keeps the jaws of the clamp secured on the zipper pull, but on the hemostat clamp, the locking mechanism of the handle keeps the jaws locked in place. What is significant is that the jaws remain locked in place once they are clamped on the zipper pull of a zipper.

DETAILED DESCRIPTION OF THE EXEMPLARY EMBODIMENTS

Figure 1:
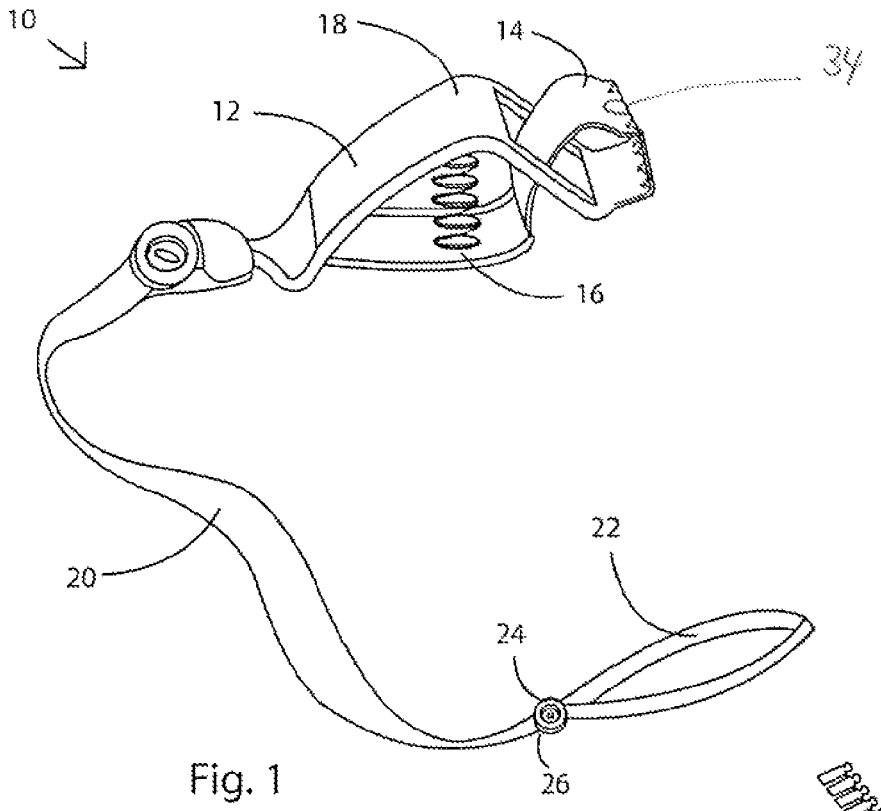
FIG. 1 is a perspective view of the disclosed zipper assist device.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Shown in FIG. 1 is the disclosed zipper assist device 10. The device includes a clamp 12 with the clamp including jaws 14, a spring 16, and clamp release structures 18. The clamp shown in FIG. 1 is the type which is sometimes called an alligator clamp, but other types of clamps can be used. A clamp called a center spring multipurpose clip, sold by Meuller Electric, is an example of this type of clamp. The clamp can include teeth on the ends of the clamp jaws, or can have smooth edges to the jaws. There is preferably a notch 34 in one or both of the jaws. This notch secures the zipper pull tab more securely in the jaws of the clamp. Suitable clamps include other types of spring clamps with handles and jaws as well as gripping type devices such as vice grip type closures and hemostat type closures, which have no springs. What is required is the ability to place the jaws of the clamp on the zipper pull and attach it to the zipper pull or the place where the zipper pull attaches to the zipper, and have it stay attached until it is specifically released by the user. Alligator clamps are typically made of metal, but other type of spring clamps can be made of plastic. Shown in FIG. 1 is a pull strap 20, which in this case is secured into loops 22 at either end, with one loop securing the pull strap 20 to the clamp 12. In the device shown in FIG. 1 the loops are formed by buttons 24 in button holes 26 in a ribbon type fabric. However, pull straps can be made of any flexible material such as string, cord, small rope, braided or monofilament line, or flat strips of fabric such as ribbon or tape. The pull strap can also be a rigid metal piece which would typically be straight but would also work with some curvature. If in the form of a rigid rod the pull strap can be made of any type of metal, plastic or wood.

The disclosed technology is also a method of closing a hard-to-reach zipper. The typical zipper has a zipper slide 28, a zipper pull 30 attached to said slide, and two tracks of intermeshing zipper teeth 32. The disclosed method includes the following steps.

Figure 2:
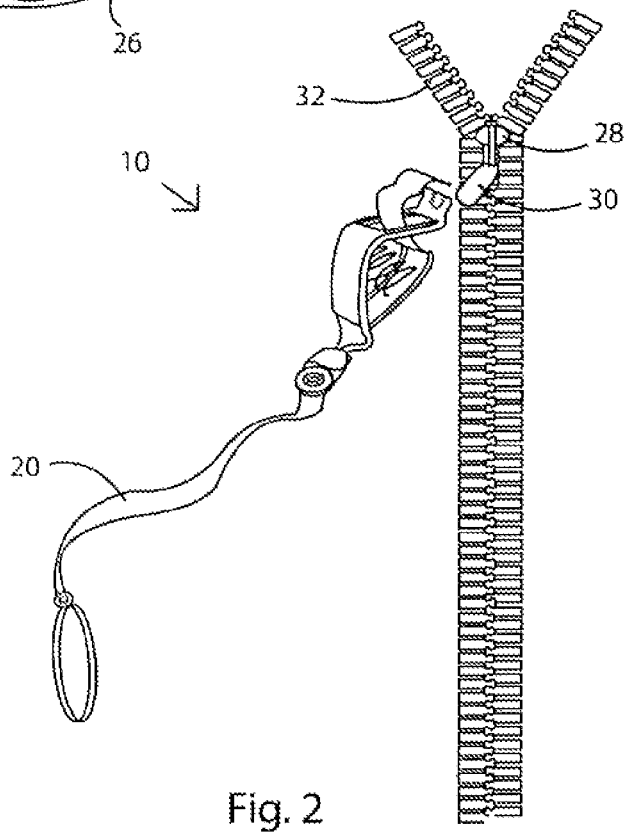
FIG. 2 is a perspective view of the disclosed zipper assist device adjacent to a partially closed zipper.
Figure 3:
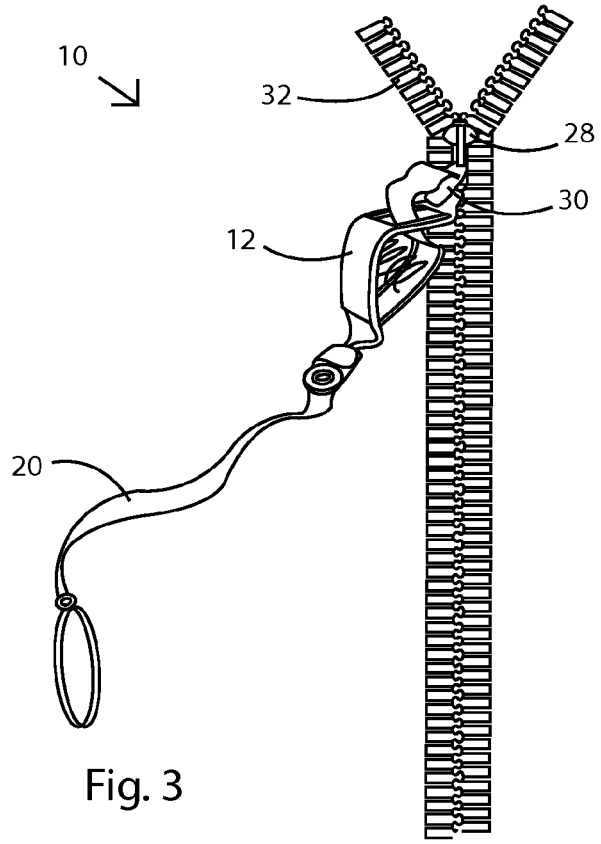
FIG. 3 is a perspective view of a partially closed zipper and the disclosed zipper assist device attached.

The first step is attaching a zipper assist device 10 of the disclosed technology to the zipper pull 30 as shown is FIG. 2. The zipper to be closed is typically on a garment such as a dress, and the zipper assist device 10 can be attached to the zipper pull 30 before the garment is put on, or whenever the zipper pull is easily accessible. The zipper assist device 10 of this method includes a clamp 12 with a pair of jaws 14 which grip the zipper pull 30 and which are urged together by a spring 16. An important design consideration of the disclosed technology is that the clamp attaches to the zipper pull 30 by gripping the zipper pull 30, and not by the use of a hook or pin which engages a hole in the zipper pull which is present in some zipper pulls. The disclosed zipper assist device 10 preferably includes a pull strap 20 attached to the clamp 12, with the pull strap 20 being either a flexible cord or a rigid rod. FIG. 3 shows the disclosed zipper assist device attached to a zipper pull 30.

Figure 4:
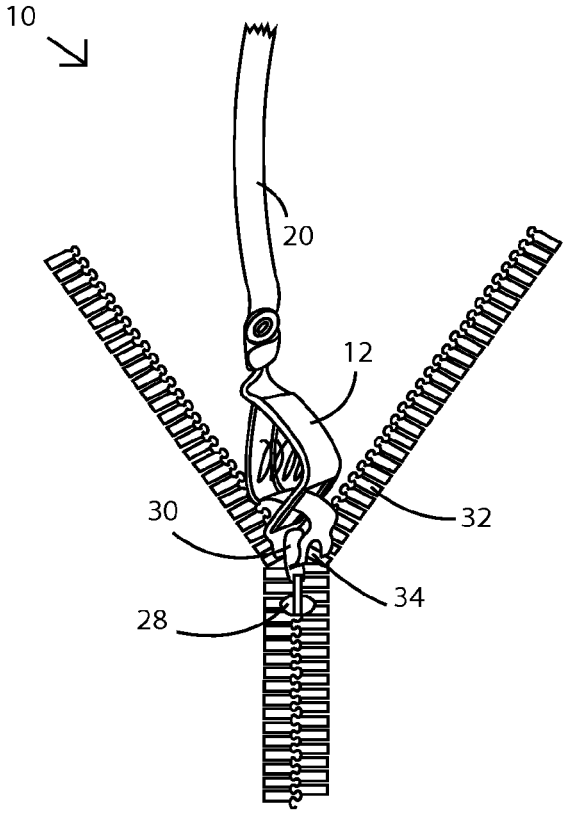
FIG. 4 is a perspective view of a zipper pull with the disclosed zipper assist device attached, and pulling the zipper upward and closing the zipper.

The next step in the method, as shown in FIG. 4, is pulling on the pull strap 20 attached to the clamp 12, in order to move the zipper slide 30 along the zipper tooth tracks, until the zipper has reached the desired position or the end of the zipper tooth tracks.

The next step is removing the zipper assist device 10 from the zipper pull 30 when the zipper is fully closed. The process is reversed to open the zipper when the garment is to be removed.

While certain exemplary embodiments are shown in the Figures and described in this disclosure, it is to be distinctly understood that the presently disclosed inventive concept(s) v is not limited thereto but may be variously embodied to practice within the scope of the following claims. From the foregoing description, it will be apparent that various changes may be made without departing from the spirit and scope of the disclosure as defined by the following claims.

What is claimed is:

1. A zipper assist device, for use with a zipper having intermeshing zipper teeth, a slider and a zipper pull with no opening, comprising:

a clamp for grasping said zipper pull at a point adjacent to said slider, said clamp having two clamp jaws with a pull tab engaging notch defined in said clamp jaws, with a spring in said clamp urging said clamp jaws together, with said clamp configured to open when a user presses on said jaws, and to close on said zipper pull by spring action, with said clamp configured to engage said zipper pull by frictional engagement of said pull tab engaging notch on sides of said zipper pull; and a pull strap with a first end and a second end, with said first end of said pull strap attached to said clamp at an end opposite said clamp jaws, with said pull strap configured to allow a user to close a zipper by pulling on said pull strap and thereby moving said slider on said zipper.

2. The zipper assist device of claim 1 in which said pull strap is a flexible cord.

3. The zipper assist device of claim 1 in which said clamp jaws are generally S shaped with a middle portion and opposing gripping jaws on a front end, with said jaws middle portion pushed apart by a spring, which causes said gripping teeth to be pressed together when said middle portion is released.

4. A zipper assist device, for use with a zipper having intermeshing zipper teeth, a slider and a zipper pull with no opening, comprising:

a clamp for grasping said zipper pull at a point adjacent to said slider, said clamp having two clamp jaws, with a spring in said clamp urging said clamp jaws together, with at least one of said clamp jaws defining a pull tab engaging notch, for securing said zipper pull, with said clamp configured to open when a user presses on said jaws, and to close on said zipper pull by spring action, with said clamp configured to grip by said zipper pull by frictional engagement on sides of said zipper pull, with said clamp jaws being generally S shaped with a middle portion and opposing gripping jaws on a front end, with said jaws middle portion pushed apart by a spring, which causes said gripping teeth to be pressed together when said middle portion is released; and a pull strap made of flexible cord, with a first end and a second end, with said first end of said pull strap attached to said clamp at an end opposite said clamp jaws, with said pull strap configured to allow a user to close a zipper by pulling on said pull strap and thereby moving said slider on said zipper.

5. A method of closing a hard-to-reach zipper on an article of clothing, the zipper having a zipper slide, a zipper pull with no opening attached to said slide, and two of intermeshing zipper teeth tracks, with the method comprising the steps of:

attaching a zipper assist device to said zipper pull, said zipper assist device comprising a clamp with a pair of jaws which grip said zipper pull and which are urged together by a spring, in which one or both of said clamp jaws define a pull tab securing notch, with said clamp attaching to said zipper pull by gripping sides of said zipper pull by friction from said jaws of said clamp and further comprising a pull strap attached to said clamp;

pulling on said pull strap attached to said clamp in order to move said zipper slide along said zipper teeth tracks; and removing said zipper assist device from said zipper pull when said zipper is fully closed.

6. The method of claim 5 which further comprises the step of attaching the zipper pull device to a zipper pull before said article of clothing is worn by a user.

* * * * *